US009360270B2

(12) United States Patent
Pruett et al.

(10) Patent No.: US 9,360,270 B2
(45) Date of Patent: Jun. 7, 2016

(54) LAUNCHER WITH MULTI-PART PUSHER, AND METHOD

(71) Applicant: Raytheon Company, Waltham, MA (US)

(72) Inventors: James A. Pruett, Allen, TX (US); Purnachandra R. Gogineni, Tucson, AZ (US); Zachary Williamson, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 230 days.

(21) Appl. No.: 13/972,201

(22) Filed: Aug. 21, 2013

(65) Prior Publication Data

US 2015/0053193 A1 Feb. 26, 2015

(51) Int. Cl.

| | |
|---|---|
| ***F41F 7/00*** | (2006.01) |
| ***F41B 11/73*** | (2013.01) |
| ***F41B 11/80*** | (2013.01) |

(52) U.S. Cl.

CPC ..... *F41B 11/73* (2013.01); *F41B 11/80* (2013.01); *F41F 7/00* (2013.01)

(58) Field of Classification Search

CPC ..... F41B 11/73; F41B 11/80; F41F 7/00

USPC ..... 89/1.81, 1.816, 1.818, 1.819, 1.8, 89/1.809; 124/61; 102/342; 244/63

See application file for complete search history.

(56) References Cited

U.S. PATENT DOCUMENTS

| | | | | |
|---|---|---|---|---|
| 94,610 | A | 9/1869 | Kafer | |
| 4,492,143 | A * | 1/1985 | Ruhle | F41F 3/073 248/632 |
| 4,773,300 | A | 9/1988 | Klatt et al. | |
| 4,991,493 | A | 2/1991 | Luojus | |
| 5,542,504 | A | 8/1996 | Berwanger | |
| 5,878,574 | A | 3/1999 | Linkner, Jr. et al. | |
| 6,371,002 | B1 * | 4/2002 | MacLeod | F41F 3/04 89/1.81 |
| 7,207,254 | B2 * | 4/2007 | Veitch | F41F 3/04 89/1.807 |
| 2002/0073831 | A1 * | 6/2002 | MacLeon | F41F 3/04 89/1.81 |
| 2003/0033926 | A1 * | 2/2003 | MacLeod | F41F 3/04 89/1.81 |
| 2003/0051687 | A1 | 3/2003 | Walters | |
| 2010/0219034 | A1 | 9/2010 | Wheals et al. | |
| 2012/0210856 | A1 * | 8/2012 | Paulic | F41F 1/00 89/5 |
| 2012/0291743 | A1 | 11/2012 | Hamby | |

* cited by examiner

*Primary Examiner* — Reginald Tillman, Jr.
(74) *Attorney, Agent, or Firm* — Renner, Otto, Boisselle & Sklar,

(57) ABSTRACT

A launcher includes a pusher that has parts that move relative to one another to provide desired forces or accelerations to corresponding parts of an object to be launched. Pressurized gasses are used to move the pusher to eject the object from the launcher. The parts of the pusher engage the different parts of the object to account for differences in shape and/or orientation of the parts of the objects, and to provide desired accelerations to the object parts. The pusher parts may include a piston or diaphragm that moves relative to an outer annular part of the pusher. The piston or diaphragm may press against a warhead explosive or other payload of a missile, with the outer part pressing against a fuselage or casing of the missile, in which the payload is mounted. Use of the pusher with multiple parts minimizes stresses between the object parts.

20 Claims, 3 Drawing Sheets

LAUNCHER WITH MULTI-PART PUSHER, AND METHOD

FIELD OF THE INVENTION

The invention is in the field of launchers for objects such as missiles.

DESCRIPTION OF THE RELATED ART

A missile or ordnance launched by expanding gasses may be protected from the expanding gasses by a pusher plate. The load path from the pusher plate into the missile could be through various sections of the missile including the warhead explosive. During launch, the forces acting through a pusher plate on a warhead housing may cause stresses in the warhead explosive that exceed the explosive's material strength. Exceeding the explosive's material strength can cause misshapes, rips, and/or tears that may cause improper detonation.

SUMMARY OF THE INVENTION

A launcher includes a multi-part pusher with parts that are movable relative to one another.

According to an aspect of the invention, a launcher includes: a pressurized gas source or gas generator that provides pressurized gas; and a pusher for transmitting force from the pressurized gas to an object to be launched. A first part of the pusher is movable relative to a second part of the pusher, with the parts of the pusher engaging respective parts of the object, to provide controlled acceleration of the parts of the object.

According to an aspect of the invention, a method of launching an object from a launcher, the method including: pressing a pusher against the object using pressurized gasses, to eject the object from the launcher. The pressing includes pressing parts of the pusher against corresponding parts of the object, with the parts of the pusher able to move relative to each other in a direction of the pressing.

To the accomplishment of the foregoing and related ends, the invention comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

BRIEF DESCRIPTION OF DRAWINGS

The annexed drawings, which are not necessarily to scale, show various aspects of the invention.

DETAILED DESCRIPTION

A launcher includes a pusher that has parts that move relative to one another to provide desired forces or accelerations to corresponding parts of an object to be launched. Pressurized gasses are used to move the pusher to eject the object from the launcher. The parts of the pusher engage the different parts of the object to account for differences in shape and/or orientation of the parts of the objects, and to provide desired accelerations to the object parts. The pusher parts may include a piston that moves relative to an outer annular part of the pusher. The piston may press against a warhead explosive or other sensitive payloads of a missile, with the outer part pressing against a fuselage or outer casing of the missile, in which the payload is mounted. Use of the pusher with multiple parts enables uniform acceleration of the different object parts during launch, and minimizes stresses between the object parts.

Figure 1:
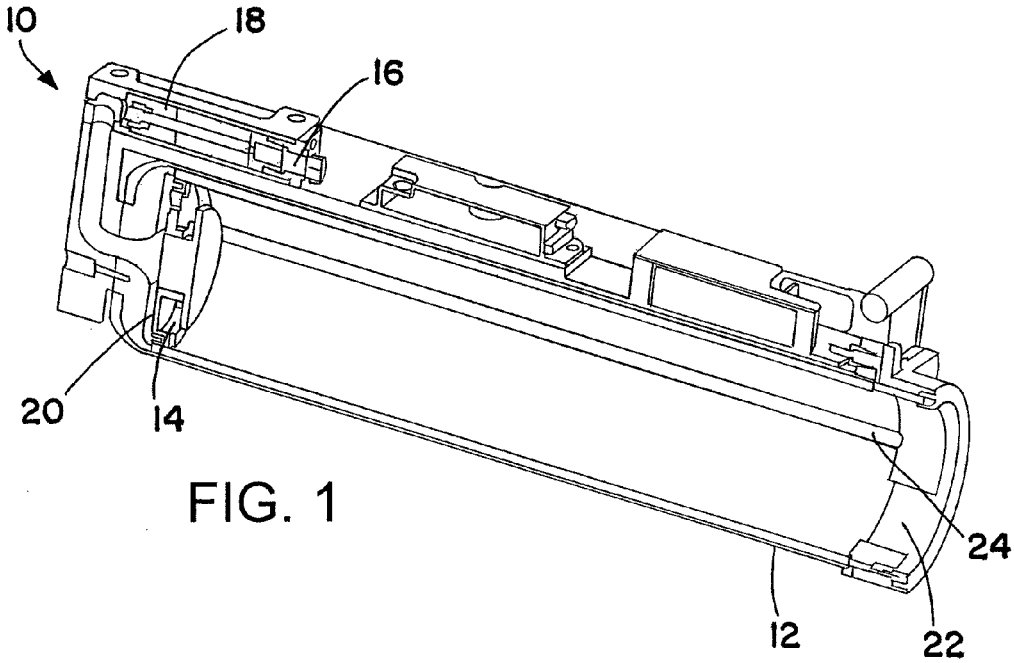
FIG. 1 is an oblique view of a launcher in accordance with an embodiment of the invention, with part of the launcher removed for illustration purposes.

FIG. 1 shows a launcher 10 that is used to launch an object, such as a missile. The launcher 10 includes a launch tube (or hollow launch portion) 12 that houses the object prior to launch. The object is launched from the launch tube 12 using a pusher 14 that pushes the object out from the launch tube 12. The pusher 14 is moved using pressurized gasses produced by a gas generator 16. The gas generator 16 may include materials used to generate gases for air bag inflation, an example of such material being sodium azide, which produces nitrogen when ignited. Many other gas generating materials are possible. While ignitable materials may be used for performing a soft launch of a launchable object, hard launches may be performed using a more energetic material, for example a gas-generating material that may be detonated. The gas generator 16 may be part of a cartridge 18. When activated, the gas generator 16 expels pressurized gases into a chamber 20 behind the pusher 14, moving the pusher toward an open end 22 of the launch tube 12. Rails 24 may be used to guide the pusher 14 and/or the object being launched.

Figure 2:
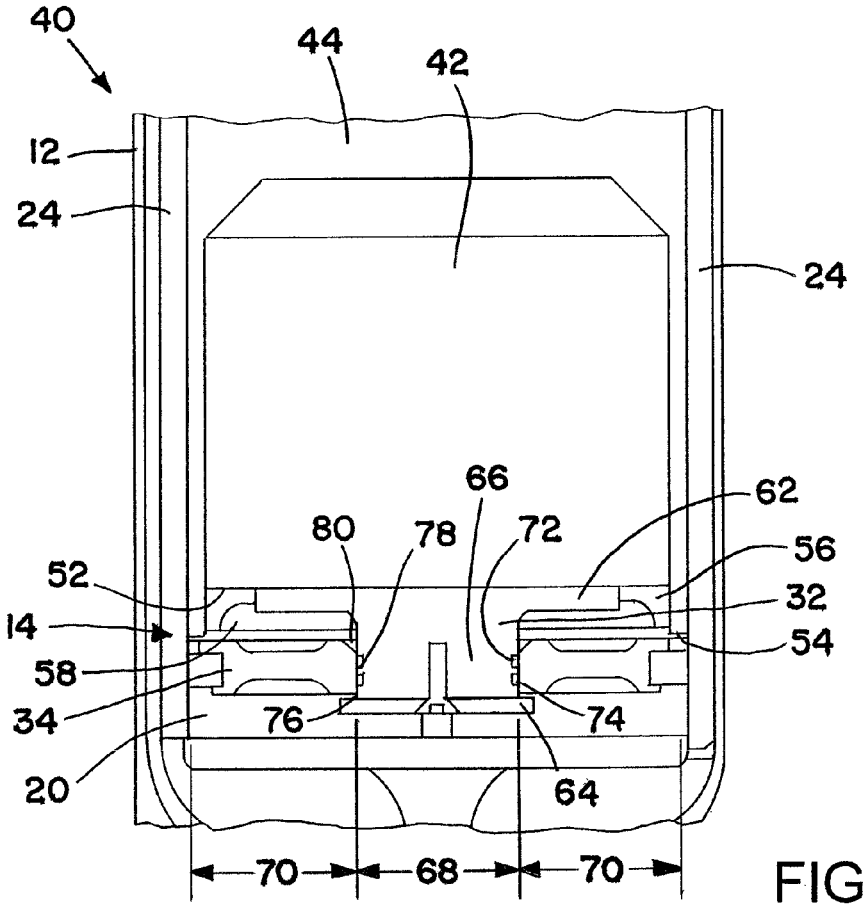
FIG. 2 is a side sectional view showing further details of the launcher of FIG. 1.
Figure 3:
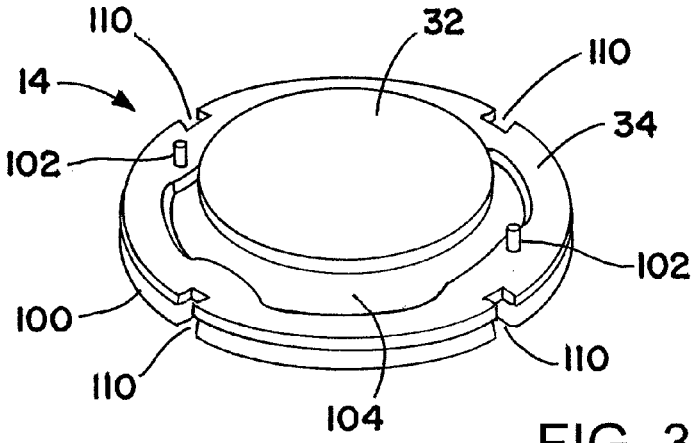
FIG. 3 is an oblique view of a pusher of the launcher of FIGS. 1 and 2.

With reference in addition to FIGS. 2 and 3, the pusher 14 has a multiple parts 32 and 34 that are move relative to each other. The parts 32 and 34 are able to move relative to one another to engage different parts of a launchable object. In the illustrated embodiment the launchable object is a missile 40, such as a countermeasure launched from an aircraft, with a payload such as a warhead explosive 42 being engaged separately from a casing 44 that surrounds the warhead explosive 42. The missile 40 is launched with the pusher pushing against its front end, and the aft end of the missile 40 being pushed out of the launch tube 12. The first pusher part 32 is a piston that is surrounded by the annular second part 34, with the parts 32 and 34 being concentric. The first part 32 can slide in an axial (longitudinal) direction relative to the second part 34. This allows the first part 32 to move as necessary to engage the outer surface 52 of the warhead explosive or other payload 42, which may not be flush with the surface 54 of the casing 44. A retaining ring 56 may be used to maintain the warhead explosive 42 in an opening 58 in the nose of the casing 44.

The ratio of the areas of the pusher parts 32 and 34 that are exposed to the expanding gases is the ratio of the forces that the pusher parts 32 and 34 apply to respective the object parts 42 and 44 that they are in contact with. This remains the case as long as the pusher parts 32 and 34 have not reached their limits of travel. The travel may be limited by a top pushing plate 62 and a bottom cap 64, which are relatively wide portions of the pusher part 32 that are on opposite sides of a relatively narrow shaft 66 of the pusher part 32. The control of forces on the pusher parts 32 and 34 may be used to keep the pusher parts 32 and 34 accelerating at the same rate during launch of the missile or other object 40, while at the same time keeping the forces between the object parts 42 and 44 desirably low. For example, it may be undesirable to push only the casing 44, while relying on transmitted forces from the casing 44 (such as shear forces) to accelerate the warhead explosive or other payload 42. This may result in a situation where the warhead explosive (or other payload) 42 is damaged or even dislodged from the casing 44. The pusher plate 14 may be configured such that the ratios of the areas of the pusher parts 32 and 34 (the ratio of the cross-sectional area 68 of the piston shaft 66 to the cross-sectional area 70 of the pusher plate 34) may be equal to the ratio of the masses of the object parts 42 and 44 that the pusher parts 32 and 34, and/or may be equal to the ratio of the desired forces on the object parts 42 and 44.

The top pusher plate 62 may be configured to spread the force on the warhead explosive 42 over a large area of the warhead explosive 42. This configuration may be flat or curved or compound shape to generally match the shape of warhead explosive 42. Toward that end the top pusher plate 62 may cover a majority or substantially all (e.g., at least 90%) of the otherwise-exposed surface of the warhead explosive 42 that is not covered by the retaining ring 56 or other parts of the missile 40.

The sliding connection between the parts 32 and 34 may be sealed, for example by use of a pair of O-ring seals 72 and 74 around the piston shaft 66. This seal could also be accomplished with a single O-ring seal 72, or with other O-ring seals in addition to seals 72 and 74. This prevents pressurized gases from escaping into the open space between the payload 42 and the second pusher part 34. The seals 72 and 74 bridge a gap 76 between the piston shaft 66 and the inner surface 78 of the pusher part 34 (surrounding the hole 80 through which the piston shaft 66 extends). The seals 72 and 74 may be flexible, so as to allow some tilting of the piston 32 relative to the pusher plate 34, for example a tilting of 10 degrees or less, or of 5 degrees or less. The tilting may allow for better engagement of the piston part 32 and the warhead explosive or payload 42, which is useful in situations where the outer surface 52 of the warhead explosive 42 is not parallel to a plane defined by an end surface 54 of the casing 44.

The pusher 14 may have other features, such as a gasket 100 around the outside of the annular part 34 to maintain a seal between the pusher 14 and the launch tube 12. The pusher part 34 may also have pins 102 for engaging the missile 40, to prevent twisting or rotation of the missile 10 during launch. A central annular portion 104 of the annular part 34 may have a reduced thickness, to reduce weight and material usage. The outer pusher part 34 may have a series of cutouts 110 for the rails 24.

The pusher parts 32 and 34 may be made of any of a variety of suitable materials. For soft-launch applications aluminum or a suitable non-metal material may be used for the parts 32 and 34. Hard-launch applications may require stronger materials, such as steel or high-strength composites.

In one embodiment the launcher 10 may be used for launching a missile 40 that is about two feet long, with the aft end of the missile 40 pushed first out of the launch tube 12. However the launcher and the launched objects may have any of a variety of other sizes, and orientations during launch.

In the illustrated embodiment the launch tube 12 and the launched object 40 have circular cross sections. Other cross-sectional shapes are also possible for the hollow launch portion, including oblong or oval, and polygonal shapes, such as square or hexagonal.

The launcher 10 advantageously adapts to, supports, and maintains the shape and integrity of the warhead explosive 42, adapting to the location of the warhead explosive 42 within the casing 44 and/or to the tilt angle of the warhead explosive 42, with the pusher part 32 able to self-align within the launch tube 12 and relative to the pusher part 34. The ratio of the areas of the pusher parts 32 and 34 may be selected to control the relative forces on the warhead explosive 42 and the casing 44, for example to minimize stress on the warhead explosive 42, or the explosive in the warhead explosive 42. The multi-part pusher 14 is usable with a variety of types of warhead explosives, and does not require any additional controls or energy to operate. Further, the pusher 14 is able to obtain these advantages while still sealing the missile (or other payload) 40 from the expanding (pressurized) gases that are used to accomplish the launch. The warhead explosive 42 and the casing 44 may be able to be made with looser tolerances because of the configuration of the launcher 10, with the ability to control force to the individual parts of the missile (or other payload) 40.

The launcher 10 is described above for launching the missile or other types of ordnance 40, with its warhead explosive 42. An example of a missile is a countermeasure, for example to intercept an incoming weapon, such as a projectile or missile. The countermeasure may be launched from an aircraft the launcher 10 is mounted on. Alternatively a multi-part pusher such as described above may be used in launching a wide variety of other objects, with the pusher part of a similar or different type of launcher. Multi-part pushers may be used to achieve launch of missiles with other types of payloads, for example a missile with a sensor, such as an optical sensor like a camera, or another sort of sensor, such as an infrared sensor. Such pushers may be used to launch other sorts of objects, for example other types of weapons, or unmanned aerial vehicles (UAVs). The launch may be into the air or into water. The launcher may be part of a fixed installation, a transportable stationary platform or other temporarily-fixed device, or a movable vehicle. Such movable vehicles may be air vehicles, water vehicles (traveling on the water surface or under water), or ground vehicles.

What follows now are several alternative embodiment pushers. The pushers described below may have many of the features, characteristics, and advantages of the pusher 14 (FIG. 1). The pushers described below may be used with launchers similar in some respects to the launcher 10 (FIG. 1). Different features from different of the embodiments described herein may be combined in single devices, as appropriate.

Figure 4:
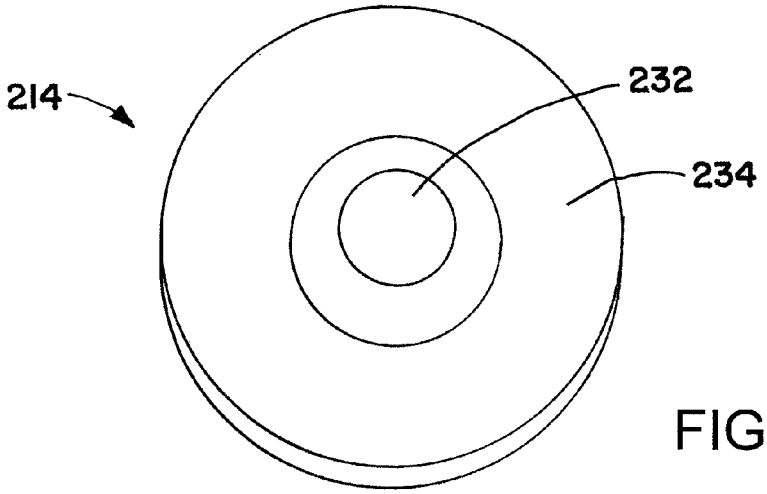
FIG. 4 is an oblique of an alternate embodiment pusher.
Figure 5:
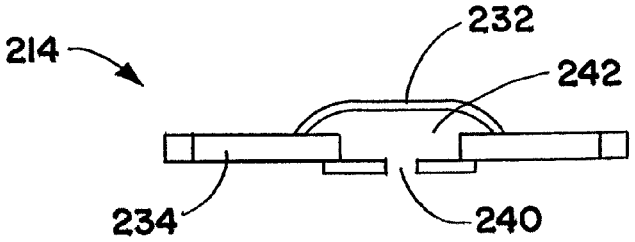
FIG. 5 is a side sectional view of the pusher of FIG. 4.

FIGS. 4 and 5 shows an alternative embodiment pusher 214 that uses a flexible diaphragm or air bag 232 in place of the piston 32 (FIG. 3). The diaphragm 232 is attached or anchored to an outer pusher part 234. The movement of the diaphragm 232 relative to the part 234 may be controlled by the configuration of a hole 240 that allows pressurized gases into a region 242 that enables the pressurized gases to push against the diaphragm 232, moving the diaphragm 232 relative to the outer pusher part 234.

Figure 6:
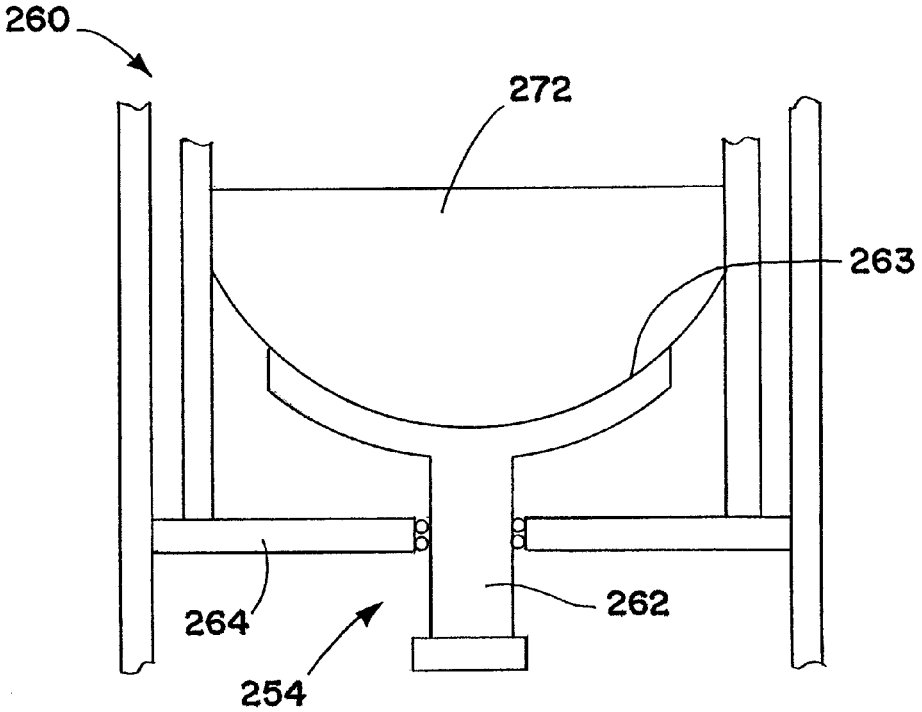
FIG. 6 is a side sectional view of another alternate embodiment launcher.

FIG. 6 shows another alternative, a pusher 254 that is part of a launcher 260. The pusher 254 has a pusher part 262, a piston with a concave face 263. The piston part 262 is movable relative to an outer pusher part 264 to engage a corresponding object part 272 that has a convex surface. The object part 272 may be part of a sensor, for example being a lens or a dome for a seeker or other sensor.

Figure 7:
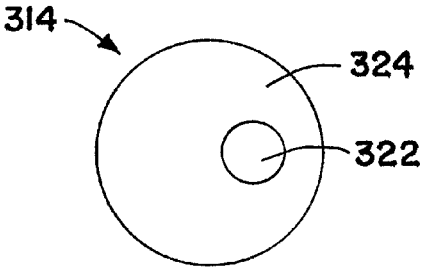
FIG. 7 is a plan view of yet another alternate embodiment launcher.

FIG. 7 shows an alternative pusher 314 that has a first part 322 that is offset from a center of a second part 324 that the first part 322 is movable relative to. The first part 322 may have the same shape as the second part 324, for example with both of the parts 322 and 324 having generally circular shapes, as shown in FIG. 7. Alternatively the parts 322 and 324 may have different shapes.

Figure 8:
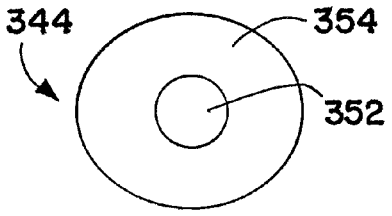
FIG. 8 is a plan view of still another alternate embodiment launcher.

FIG. 8 shows a pusher 344 that has an elliptical (oval) shape. A first part 352 is movable relative to a second part 354 that surrounds the first part 352, with the second part 354 having an elliptical outer surface shape. The first part 352 may have a circular cross-section shape, as is shown in FIG. 8, or alternatively may have another shape that is similar to or different from that of the second part 354. The elliptical shape is only one possible oblong shape that a non-circular pusher may have. Other shapes, such as various polygons, are also possible.

Figure 9:
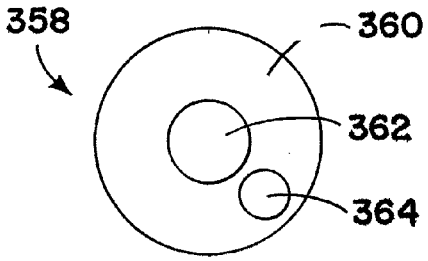
FIG. 9 is a plan view of a further alternate embodiment launcher.

FIG. 9 shows a pusher 358 that has a base plate part 360, and a pair of movable parts 362 and 364 that can move relative to the base plate part 360. The pusher 358 can be used to engage multiple parts of an object that are at different heights and/or surface orientations than a main part of the object, for example to minimize stresses between parts of the object during launch. A missile having a pair of different sensors or different sensor parts at different locations is an example of such a launchable object. Alternatively the pusher 358 may have three or more parts that are movable relative to the base plate 360.

Figure 10:
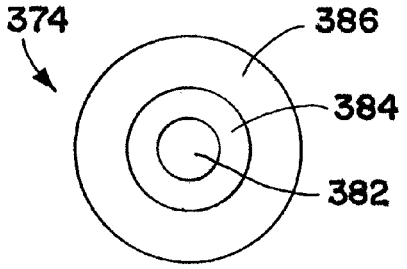
FIG. 10 is a plan view of a still further alternate embodiment launcher.

FIG. 10 shows a pusher 374 that has multiple nested movable parts 382-386. A first part 382 is movable relative to a second part 384, which in turn is movable relative to a third part 386. The parts 382-386 may be concentric, although that is not necessary. The pusher 374 may be used in a situation where multiple parts of a launchable object need support, such as for a missile with a seeker dome, and a sensor at the apex of the seeker dome.

Although the invention has been shown and described with respect to a certain preferred embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. A launcher comprising:

a pressurized gas source that provides pressurized gas; and a pusher for transmitting force from the pressurized gas to an object to be launched;

wherein a first part of the pusher is movable relative to a second part of the pusher, with the parts of the pusher are configured to engage respective parts of the object, to provide controlled acceleration of the parts of the object.

2. The launcher of claim 1, wherein the first part of the pusher is surrounded by the second part of the pusher.

3. The launcher of claim 1, wherein the parts of the pusher each have a circular cross-section.

4. The launcher of claim 1, wherein the parts of the pusher are concentric about a central axis of the pusher.

5. The launcher of claim 1, wherein the relative movement of the parts is in a direction of movement of the pusher to launch the object to be launched from a hollow launch portion of the launcher.

6. The launcher of claim 1, wherein the first part is a piston that moves within a hole in the second part.

7. The launcher of claim 1, wherein the first part is a flexible member that is anchored to the second part.

8. The launcher of claim 1, wherein the pusher further includes one or more additional parts that movable relative to second part.

9. The launcher of claim 8, wherein at least one of the additional parts is nested within the first part.

10. The launcher of claim 1, wherein a ratio of areas of the first part and the second part is selected so as to apply desired acceleration to the parts of the object during launch, to thereby minimize stresses between the parts of the object.

11. The launcher of claim 1, wherein the first part is able to tilt relative to the second part, to better engage the corresponding part of the object.

12. The launcher of claim 1, wherein the first part has an uneven surface for engaging a corresponding uneven surface on the corresponding part of the object.

13. The launcher of claim 12, wherein the first part has a concave surface, and the corresponding uneven surface of the object is a convex surface.

14. The launcher of claim 1, in combination with object to be launched.

15. The combination of claim 14, wherein the object is a missile.

16. The combination of claim 15, wherein the parts of the object include:

a payload that is pressed against by the first part of the pusher; and a casing that is pressed against by the second part of the pusher.

17. The combination of claim 16, wherein the payload includes one or more of a warhead explosive and a sensor.

18. A method of launching an object from a launcher, the method comprising:

pressing a pusher against the object using pressurized gasses, to eject the object from the launcher;

wherein the pressing includes pressing parts of the pusher against corresponding parts of the object, with the parts of the pusher able to move relative to each other in a direction of the pressing.

19. The method of claim 18, wherein the pressing includes controlling the relative pressing forces of the parts of the pusher against the parts of the object, in order to minimize stresses between the parts of the object during the launching.

20. The method of claim 18, wherein the parts of the pusher are able to tilt relative to each other to accommodate the pressing to different orientations of surfaces of the parts of the object.

* * * * *